US006374598B1

(12) United States Patent
Neuschwander

(10) Patent No.: US 6,374,598 B1
(45) Date of Patent: Apr. 23, 2002

(54) DEVICE FOR COOLING GASES

(75) Inventor: Helmut Neuschwander, Ludwigsburg (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/623,676

(22) PCT Filed: Feb. 6, 1999

(86) PCT No.: PCT/EP99/00799

§ 371 Date: Sep. 7, 2000

§ 102(e) Date: Sep. 7, 2000

(87) PCT Pub. No.: WO99/45264

PCT Pub. Date: Sep. 10, 1999

(30) Foreign Application Priority Data

Mar. 7, 1998 (DE) ..... 198 09 859

(51) Int. Cl.[7] ..... F01N 3/00

(52) U.S. Cl. ..... 60/298; 60/278; 60/320; 165/154

(58) Field of Search ..... 60/298, 320, 278; 165/154, 164, 179, DIG. 395

(56) References Cited

U.S. PATENT DOCUMENTS

| | | | | | |
|---|---|---|---|---|---|
| 3,748,830 | A | * | 7/1973 | Ross et al. | 60/320 |
| 4,233,812 | A | * | 11/1980 | Leistritz | 60/320 |
| 4,345,644 | A | * | 8/1982 | Dankowski | 165/154 |
| 4,368,777 | A | * | 1/1983 | Grasso | 165/154 |
| 4,385,501 | A | * | 5/1983 | Ziegler | 165/154 |
| 4,474,011 | A | * | 10/1984 | Nelson et al. | 165/145 |
| 4,685,292 | A | * | 8/1987 | Brigham et al. | 60/320 |
| 4,685,430 | A | * | 8/1987 | Ap | 60/320 |
| 4,715,809 | A | * | 12/1987 | Langhoff et al. | 165/134.1 |
| 5,538,079 | A | * | 7/1996 | Pawlick | 165/153 |
| 5,649,589 | A | * | 7/1997 | Carpentier | 165/154 |
| 6,155,042 | A | * | 12/2000 | Perset et al. | |
| 6,178,744 | B1 | * | 1/2001 | Perset | 60/298 |

FOREIGN PATENT DOCUMENTS

| | | | | |
|---|---|---|---|---|
| DE | 2401204 | * | 7/1975 | 60/298 |
| FR | 2505403 | * | 11/1982 | 60/320 |
| GB | 22594 | * | 3/1906 | 60/320 |
| GB | 2184825 | * | 7/1987 | |
| JP | 0000345 | * | 1/1982 | 60/298 |
| JP | 0135313 | * | 8/1983 | 60/320 |

* cited by examiner

*Primary Examiner*—Thomas Denion
*Assistant Examiner*—Diem Tran
(74) *Attorney, Agent, or Firm*—Crowell & Moring LLP

(57) ABSTRACT

A device for cooling gases in which the gas to be cooled can be fed through channels (5) of a cooling device (1). Adjacent the gas channels (5) in the cooling device (1) are coolant channels (10) for a circulating coolant. In the cooling device, the channels (10) for the coolant are positioned centrally in the interior and the channels (5) for the gas to be cooled are positioned radially outwardly.

4 Claims, 1 Drawing Sheet

DEVICE FOR COOLING GASES

BACKGROUND OF THE INVENTION

The invention relates to an apparatus for cooling gases, especially in the exhaust tract of an internal combustion engine.

It is know, for example, to cool a hot gas through a special configuration of the gas pipe—made of metal, as a rule—or by mixing of the gas with a cooler medium.

SUMMARY OF THE INVENTION

The invention is addressed to the problem of constructing a device for cooling gases in such a way that it is possible to arrange it in a simple manner in already existing cooling systems.

The apparatus of the invention, of the kind stated in the beginning, is advantageously configured such that the gas can be carried through channels in a cooling device, channels for a flowing coolant medium also being present in the cooling device in the neighborhood of the channels for the gas. It is thus possible in a simple manner to integrate the cooling device for the gas in an already existing coolant circuit bearing a corresponding coolant which, as a rule, is a liquid.

To achieve good heat removal, the cooling device has the channels for the coolant centered inside of it and, radially on its exterior, the channels for the gas to be cooled, while it has cooling fins on its exterior for further improvement of heat removal.

In a preferred embodiment the gas is branched off from the exhaust gases of an internal combustion engine and is returned into the air intake tract of the internal combustion engine (so-called exhaust gas return—EGR) and the cooling medium is the coolant in the coolant circuit of the internal combustion engine.

The cooling device of the invention can be produced advantageously by making the cooling device with the channels from pressure-cast parts, a first cover being present with an annular inlet for the gas being cooled and a second cover with a funnel-shaped outlet for the gas being cooled. With the annular inlet an especially uniform distribution in the channels of the cooling device when it flows in is made possible, and with the funnel-shaped outlet a uniform passage through the channels can be achieved.

Furthermore, in this embodiment a middle piece is present between the covers with the channels, so that one set of channels in the cooling device permits the gas to flow through them and the other set of channels permits the cooling medium to flow in alternating directions, while an extruded aluminum profile bearing the cooling fins is advantageously mounted externally on the middle piece.

Preferably, three channels for the coolant are formed by radial dividing walls inside of the cooling device, and externally six channels for the gas being cooled are likewise formed by radial dividing walls.

BRIEF DESCRIPTION OF THE DRAWINGS

An embodiment of the cooling device of the invention is explained with the aid of the drawing, wherein.

DETAILED DESCRIPTION OF THE WORKING EMBODIMENTS

Figure 1:
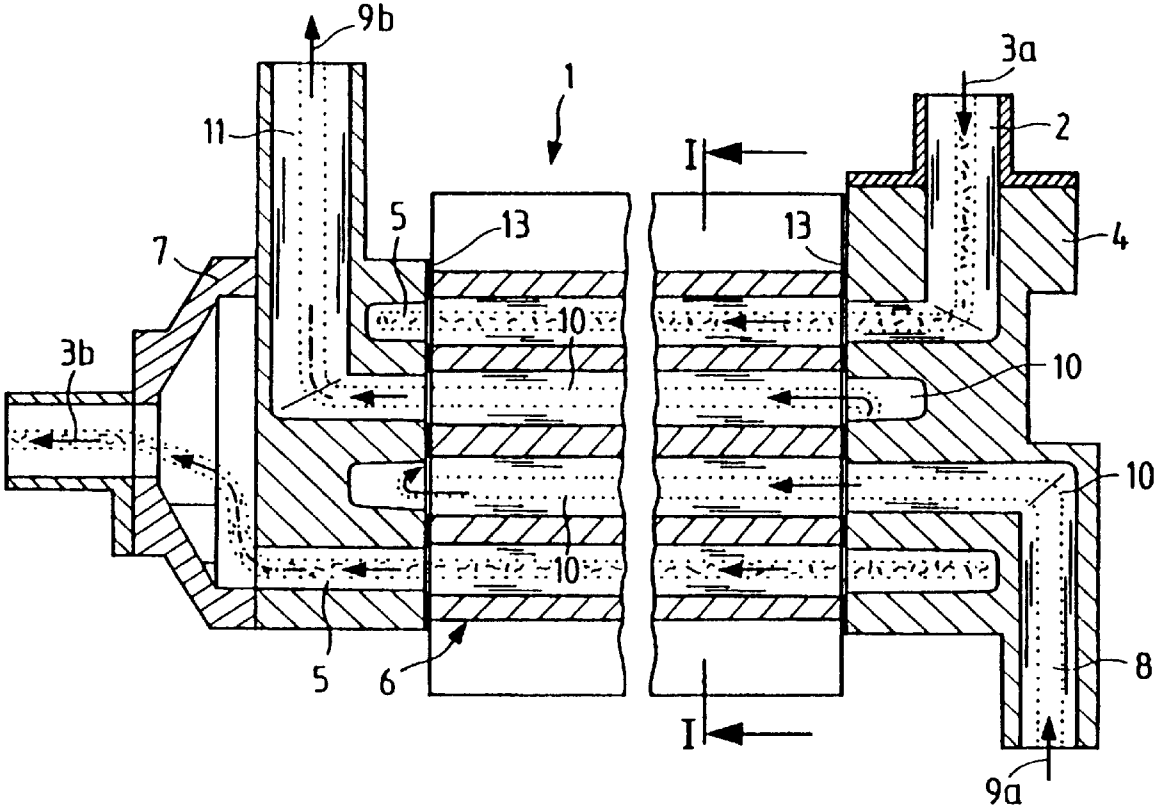
FIG. 1 is a longitudinal section through such a device in the exhaust gas return of an internal combustion engine, and FIG. 2 a cross section I—I through the embodiment of FIG. 1.

In FIG. 1 is a section through a device 1 for cooling exhaust gas, with an exhaust gas return for an internal combustion engine here not shown. The exhaust gas flows annularly to a gas inlet 2 according to arrow 3*a* into a first cover 4 of the device. The exhaust gas flows through channels 5 through a middle piece 6 of any desired length, and exits the cooling device 1 from a funnel-shaped cover 7 according to arrow 3*b*.

Figure 2:
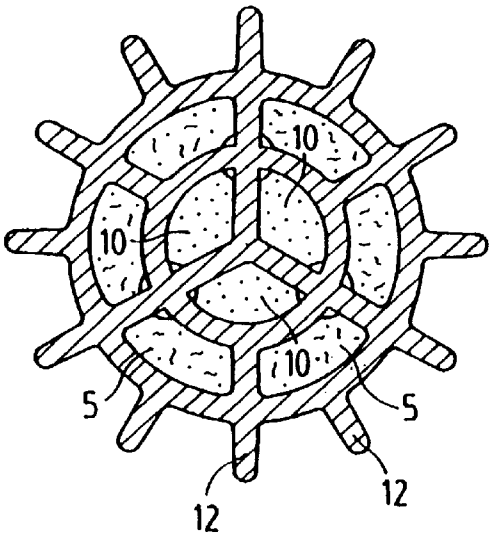

To clarify the course of the channels 5 and of the channels described further below, reference is made to FIG. 2, which shows a cross section I—I through the intermediate piece 6. This shows the course of the channels 5 through which the exhaust gas flows parallel through the cooling device 1.

Also present on the cooling device 1 is an inlet 8 for a coolant, which is here the cooling liquid of the cooling system of the internal combustion engine through which the cooling liquid flows according to the arrow 9*a* into the device 1 and is carried through channels 10 in alternating directions to the outlet 11 from which it exits again according to arrow 9*b*. The position of the channels 10 can also be seen clearly in FIG. 2.

The channels 5 and 10 are formed in parts 4, 7 and 6 of the cooling device 1 which are made as castings, and they are sealed with regard to one another by gaskets 13. To further increase the removal of heat from the exhaust gas flowing in the outer channels 5, cooling fins 12 of an extruded aluminum profile are disposed externally on the device 1 and especially on the intermediate piece 6.

LIST OF REFERENCE NUMERALS

1=Device for cooling exhaust gases
2=Gas inlet
3*a*,3*b*=Arrows (Gas stream)
4 Cover
5=Channels
6=Intermediate piece
7=Cover
8=Inlet for coolant
9*a*9*b*=Arrows (Coolant stream)
10=Channels
11=Outlet for coolant
12=Cooling fins
31=Seals

What is claimed is:

1. An apparatus for cooling a gas, said apparatus comprising a cooling device having a plurality of gas channels through which a gas to be cooled is capable of being conveyed and a plurality of coolant channels through which a coolant is capable of being conveyed adjacent said gas channels, said cooling device being produced from pressure cast parts including a first cover with an annular inlet for the gas to be cooled, a second cover with a funnel-shaped outlet for cooled gas, and an intermediate piece with the channels formed therein being arranged between the first cover and the second cover, said channels being arranged so that both the gas to be cooled and the coolant flow in alternating directions through the cooling device, wherein a plurality of cooling fins is affixed externally on the intermediate piece and comprises an extruded aluminum profile piece.

2. An apparatus according to claim 1, wherein the channels for the coolant are arranged centrally in the cooling device and the channels for the gas to be cooled are arranged around the circumference of the cooling device radially outwardly of the coolant channels.

3. An apparatus according to claim 1, wherein the gas to be cooled is exhaust gas diverted from an exhaust of an internal combustion engine for recirculation to an air intake tract of the engine, and wherein the coolant is a cooling liquid from a cooling circuit of the internal combustion engine.

4. An apparatus according to claim 3, wherein said cooling device comprises three internal channels for the coolant formed by radial dividing walls centrally inside of the cooling device, and six outer channels for the gas to be cooled which are likewise formed by radial dividing walls.

* * * * *